United States Patent [19]

Ohe et al.

[11] Patent Number: 4,626,334

[45] Date of Patent: Dec. 2, 1986

[54] ELECTRODE FOR ELECTROLYSIS

[75] Inventors: Kazuhide Ohe; Yukio Kawashima, both of Tokyo, Japan

[73] Assignee: TDK Corporation, Tokyo, Japan

[21] Appl. No.: 697,164

[22] Filed: Feb. 1, 1985

[51] Int. Cl.[4] ..... C25B 11/00

[52] U.S. Cl. ..... 204/290 R; 204/290 F

[58] Field of Search ..... 204/290 F, 290 R

[56] References Cited

U.S. PATENT DOCUMENTS 3,793,164 2/1974 Kolb ..... 204/290 F 4,513,102 4/1985 Hutchings ..... 204/290 F

*Primary Examiner*—John F. Niebling

*Attorney, Agent, or Firm*—Oblon, Fisher, Spivak, McClelland & Maier

[57] ABSTRACT

An anode comprising an electroconductive substrate provided with a $(Ru\text{-}Sn)O_2$ solid solution coating is useful in brine electrolysis. The improved coating has a composition of (i) 3 to 45 mol % of ruthenium oxide, (ii) 0.1 to 30 mol % of at least one member selected from metallic platinum, platinum oxide, and iridium oxide, and (iii) 50 to 96.9 mol % of tin oxide which may be partially replaced by antimony.

9 Claims, 1 Drawing Figure

ELECTRODE FOR ELECTROLYSIS

BACKGROUND OF THE INVENTION

This invention relates to electrodes for use in the electrolysis of aqueous alkali metal salt solutions.

Ruthenium dioxide ($RuO_2$) type electrodes are well known anodes for use in the electrolysis of aqueous alkali metal salt solutions, typically brine electrolysis. A typical example of the ruthenium dioxide type electrodes is disclosed in Japanese Patent Publication No. 46-21884 as comprising a valve metal substrate having a coating of $(Ru\text{-}Ti)O_2$ solid solution applied thereon. Because of its extended lifetime, this electrode has been commercially utilized as a typical metal electrode. Unfortunately, it provides a low anodic current efficiency while evolving a great volume of oxygen.

Japanese Patent Publication No. 50-11330 discloses another electrode having a coating of $(Ru\text{-}Sn)O_2$ solid solution containing at least 50 mol% of $SnO_2$. This electrode also has an extended lifetime. Contents of $RuO_2$ of the order of 30 mol% provide sufficient chlorine overvoltage, but at the same time, lead to some disadvantages including low oxygen overvoltage, increased oxygen evolution, and low current efficiency.

In order to increase oxygen overvoltage in these coating compositions, the content of $RuO_2$ activator should be reduced to about 20 mol%. However, this is unacceptable because chlorine overvoltage is correspondingly increased.

Japanese Patent Publication No. 52-28106 or U.S. Pat. No. 3,776,834 discloses another electrode having a coating of $(Ru\text{-}Sn\text{-}Ti)O_2$ solid solution composed of 14 to 20 mol% of $RuO_2$, 67 to 71 mol% of $TiO_2$, and 9 to 19 mol% of $SnO_2$. The coating composition is proposed in order to improve the oxygen overvoltage and hence, the current efficiency of the $(Ru\text{-}Ti)O_2$ solid solution coated electrode. The electrode is described as successful in reducing oxygen evolution by about 20% as compared with the previous $(Ru\text{-}Ti)O_2$ coated electrode. It is still unsatisfactory with respect to oxygen evolution and current efficiency.

SUMMARY OF THE INVENTION

It is, therefore, an object of the present invention to provide a new and improved electrode of the $(Ru\text{-}Sn)O_2$ solid solution type which can provide increased oxygen overvoltage, reduced oxygen evolution, and improved anodic current efficiency while taking advantage of the lifetime and chlorine overvoltage of $(Ru\text{-}Sn)O_2$ solid solution-coated electrodes.

According to a first aspect of the present invention, there is provided an electrode for use in electrolysis comprising an electroconductive substrate provided over at least a portion of its outer surface with a coating of a platinum group metal oxide catalyst, characterized in that said coating comprises (i) 3 to 45 mol% of ruthenium oxide, (ii) 0.1 to 30 mol% of at least one member selected from metallic platinum, platinum oxide, and iridium oxide, and (iii) 50 to 96.9 mol% of tin oxide.

According to a second aspect of the present invention, there is provided an electrode for use in electrolysis comprising an electroconductive substrate provided over at least a portion of its outer surface with a coating of a platinum group metal oxide catalyst, characterized in that said coating comprises (i) 3 to 45 mol% of ruthenium oxide, (ii) 0.1 to 30 mol% of at least one member selected from metallic platinum, platinum oxide, and iridium oxide, and (iii) 50 to 96.9 mol% of tin oxide with antimony substituting for not more than 10 mol% of the tin.

DETAILED DESCRIPTION OF THE INVENTION

Figure 1:
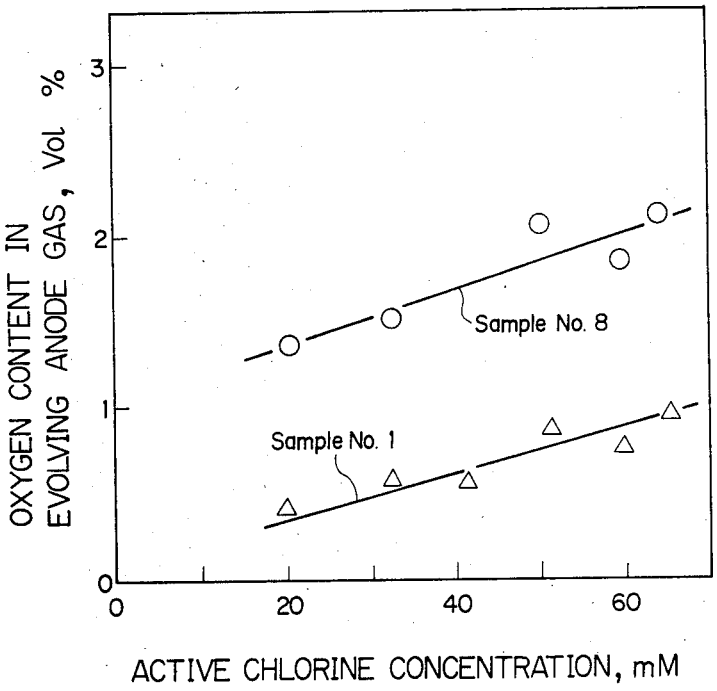
FIG. 1 is a diagram showing how the content of oxygen in evolving anode gas varies with active chlorine concentration when brine is electrolyzed in a membrane type chlorine cell with anodes of sample Nos. 1 and 8.

The electroconductive substrates from which the electrodes of the present invention are formed may be selected from valve metals such as titanium, tantalum, zirconium, and niobium, and alloys thereof with titanium being preferred. The substrate will considerably vary in shape and size depending on the intended application, but may preferably be in the form of a rod or plate of the appropriate material.

The electroconductive substrates are provided with coatings comprising (i) 3 to 45 mol% of ruthenium oxide, (ii) 0.1 to 30 mol% of metallic platinum and/or platinum oxide and/or iridium oxide, and (iii) 50 to 96.9 mol% of tin oxide.

The coating contains (i) 3 to 45 mol% of ruthenium oxide generally in the form of $RuO_2$. With contents of $RuO_2$ of less than 3 mol%, the chlorine overvoltage increases beyond the commercially acceptable level. Contents of $RuO_2$ of more than 45 mol% result in reduced oxygen overvoltage, increased oxygen evolution, and deteriorated current efficiency. Better results are obtained when the $RuO_2$ content ranges from 10 to 30 mol%.

The coating contains (ii) 0.1 to 30 mol% of at least one member selected from metallic platinum, platinum oxide, and iridium oxide. Contents of component (ii) of less than 0.1 mol% result in increased chlorine overvoltage, reduced oxygen overvoltage or increased oxygen evolution, and deteriorated current efficiency. Better results are obtained when the content of component (ii) ranges from 5 to 15 mol%.

Component (ii) may be one or two or three members selected from the group consisting of metallic platinum, platinum oxide, and iridium oxide. Under usual preparation conditions, platinum and iridium are present as Pt and $IrO_2$, respectively. Thus, component (ii) is generally present in the form of Pt; or $Pt+IrO_2$; or $IrO_2$. As the case may be, a trace amount of platimum oxide is contained in addition thereto. The ratio of Pt to $IrO_2$ is not particularly limited.

The coating further contains (iii) 50 to 96.9 mol% of tin oxide generally in the form of $SnO_2$. Contents of $SnO_2$ of less than 50 mol% result in reduced oxygen overvoltage, increased oxygen evolution, and deteriorated current efficiency. With contents of $SnO_2$ of more than 96.9 mol%, the chlorine overvoltage increases beyond the acceptable level. Better results are obtained when the $SnO_2$ content ranges from 55 to 85 mol%.

According to the second aspect of the present invention, component (iii), that is, $SnO_2$ may contain or be partially replaced by antimony (Sb) in an amount of not more than 10 mol% and preferably not more than 5 mol% of the tin (Sn).

Antimony Sb partially substitutes for $SnO_2$ as a dopant in the form of $Sb_2O_3$ and serves to increase conductivity. Substituting amounts of more than 10 mol% rather detract from the doping effect and deteriorate corrosion resistance.

It should be noted that $RuO_2$, $SnO_2$, and $IrO_2$, and optionally platinum oxide, form a solid solution in the coating. When metallic platinum (Pt) is present, it generally adjoins the solid solution with the intervening grain boundary.

The coating may generally be about 0.5 to 10 μm thick.

The electrodes of the present invention may be prepared by a process as will be described hereinafter.

In order to introduce ruthenium oxide into the coating, a solution of a compound thermally decomposable into ruthenium oxide, for example, $RuCl_3.3H_2O$ in a suitable solvent may be applied as by coating followed by drying and baking.

In order to introduce metallic platinum or platinum oxide into the coating, a solution of a salt thermally decomposable into metallic platinum or platinum oxide, for example, a haloplatinic acid such as hexachloroplatinic acid $H_2PtCl_6.6H_2O$ in a suitable solvent may be applied as by coating on a titanium substrate followed by drying and baking.

In order to introduce iridium oxide into the coating, a solution of a compound thermally decomposable into iridium oxide, for example, hexachloroiridic acid $H_2IrCl_6.6H_2O$ or iridium chloride $IrCl_6.H_2O$ in a suitable solvent may be applied as by coating on a titanium substrate followed by drying and baking.

In order to introduce tin oxide, optionally doped with antimony, into the coating, a solution of a salt thermally decomposable into tin oxide, for example, stannous halides such as stannous chloride and stannous compounds such as salts with carboxylic acids (e.g. octanoic acid), phosphonic acid, phosphocarboxylic acid, etc. and optionally, a salt thermally decomposable into antimony oxide, for example, antimony halides such as antimony chloride in a suitable solvent may be applied as by coating followed by drying and baking.

In order that the substrate be provided with a coating comprised of components (i), (ii), and (iii) in the specific proportion, the above-mentioned solutions of the respective components may be individually applied to the substrate surface one after another with the intervening drying and baking step. At least two of the above-mentioned solutions may be combined in this multilayer coating process.

Alternatively, a single coating solution may be prepared by combining three or four of the above-mentioned solutions of the respective components and then applied to the substrate surface. The way of applying the coating to the substrate surface is not limited to these procedures or not critical to the present invention, and any desired procedure may be used.

It is to be noted that since antimony trichloride used as the dopant to tin oxide undergoes a substantial loss due to volatilization during its baking to the substrate as will be explained below, it may be added to the coating solution in an amount greater by some factors than the stoichiometric amount corresponding to the final doping level.

The electrodes of the present invention are useful as anodes in the electrolysis of alkali metal salts such as soda electrolysis.

According to the present invention, a predetermined amount of at least one member selected from Pt, platinum oxide, and $IrO_2$ is added to a coating of the $(Ru\text{-}Sn)O_2$ solid solution type to provide a novel and improved coating which is characterized by high oxygen overvoltage, reduced oxygen evolution, and high anodic current efficiency. It is also characterized by low chlorine overvoltage and has a long lifetime. The present invention thus provides a commercially satisfactory electrode of the $RuO_2$ solid solution type.

It should be noted that the addition of platinum group metals other than platinum and iridium, for example, Pd to coating compositions of the $(Ru\text{-}Sn)O_2$ solid solution type is not successful in improving corrosion resistance.

Examples of the present invention are given below by way of illustration and not by way of limitation.

EXAMPLE 1

The starting materials used were
$RuCl_3.3H_2O$,
$H_2PtCl_6.6H_2O$,
$H_2IrCl_6.6H_2O$,
$C_{16}H_{30}O_4Sn$, and
$SbCl_3$.

These starting materials for Ru, Pt, Ir, and Sn or Sn+Sb were respectively dissolved in butanol to a concentration of 100 grams of metal per liter to form stock solutions. The Sn+Sb solution was prepared by adding 5 mol% of $SbCl_3$ to $C_{16}H_{30}O_4Sn$.

The stock solutions were mixed and agitated in predetermined ratios by taking the respective solutions by means of measuring pipets, obtaining coating solutions containing the respective components in different ratios.

Separately, titanium plates of 5×20×1 mm thick were washed with a hot solution of oxalic acid in water. The above-prepared solutions were applied to one major surface of the cleaned plates by brushing, followed by drying and firing in air at 500° C. for 10 minutes in a furnace for thermal decomposition. This brushing, drying, and baking procedure was repeated four times until the titanium plates were formed with coatings having the compositions shown in Table 1.

These samples were made anodes and measured for polarization by the potential sweep method at a sweep rate of 240 sec./volt.

Upon measurement, lead wires were connected to the uncoated surface of the samples using Dotite (trademark) and the samples except their effective area were sealed with an insulating paint.

The samples were also measured for chlorine overvoltage $\eta Cl_2$ and oxygen overvoltage $\eta O_2$ in a 30 wt% NaCl aqueous solution (adjusted to pH 1) and a 1 mole $H_2SO_4$ aqueous solution both at 30° C. and a current density of 20 mA/cm$^2$.

The results are shown in Table 1 together with oxygen content ($O_2$ vol%).

For those electrodes whose chlorine overvoltage $\eta Cl_2$ exceeds the commercially acceptable level of 100 millivolts, the percentage oxygen evolution was not measured.

The composition of the coatings shown in Table 1 was determined by fluorescent x-ray analysis.

TABLE 1

| Sample No. | Composition (mol %) Ru | Pt | Ir | Sn | Sb** | $\eta O_2$ (mV) | $\eta Cl_2$ (mV) | $O_2$ % |
|---|---|---|---|---|---|---|---|---|
| 1 | 20 | 10 | — | 70 | — | 410 | 55 | 0.5 |
| 2 | 20 | 10 | — | 70 | (2) | 410 | 55 | 0.5 |
| 3 | 20 | 7 | 3 | 70 | — | 480 | 65 | 0.5 |
| 4 | 20 | 7 | 3 | 70 | (2) | 480 | 60 | 0.5 |
| 5* | 20 | — | 10 | 70 | — | 450 | 75 | 0.5 |
| 6* | 20 | — | 10 | 70 | (2) | 440 | 75 | 0.5 |
| 7* | 20 | — | — | 80 | — | 450 | 120 | — |
| 8* | 30 | — | — | 70 | — | 350 | 60 | 2.0 |
| 9* | — | — | 20 | 80 | — | 380 | 120 | — |

*Comparative Examples
**Antimony Sb content is expressed in mol % based on the tin.

As evident from the data of Table 1, the electrodes of Ru-Sn-Pt (and/or Ir) system according to the present invention exhibit a high oxygen overvoltage while suppressing the chlorine overvoltage and oxygen evolution.

In FIG. 1, the oxygen content (expressed in vol%) in evolving anode gas is plotted with respect to the varying active chlorine concentration (expressed in millimole) during electrolysis of brine (2.5M NaCl) in an ion-exchange membrane type laboratory cell at a temperature of 55° C. and a current density of 20 A/dm$^2$. As compared with the curve of sample No. 8, the curve of sample No. 1 shows that the electrode of the present invention is more effective in suppressing the oxygen content of evolving chlorine gas.

EXAMPLE 2

Electrodes (anodes) having coatings of the compositions shown in Table 2 were prepared in the same manner as in Example 1 and determined for chlorine generation efficiency and wear resistance.

The chlorine generation efficiency was measured by placing an anode sample and a cathode in the form of a SUS 304 disc having a diameter of 30 mm in an electrolytic solution containing 0.25 moles of sodium chloride in 150 ml of water in a sealed tank. Electrolysis was carried out at a temperature of 30° C., a current density of 20 A/dm$^2$, and an electricity quantity of 100 coulombs. Thereafter, the solution was transferred into an iodine flask where iodometric titration with sodium thiosulfate was conducted to determine the concentration of hypochlorite in the solution.

The wear test was an accelerated wear test according to Vaaler's method (J. Electrochem. Soc., 117, 219(1970)). Illustratively, in a chlorine saturated solution containing 0.5 moles of NaCl and 2 moles of $NaClO_4$ at 65° C. and pH 3, electrolysis was conducted at a current density of 100 A/dm$^2$. The test was continued until the bath voltage reached 4 volts. The number of hours of successful operation until the anode had passivated is recorded as the lifetime of the anode.

Symbols used in Table 2 have the following meanings.

| Symbols | Lifetime |
|---|---|
| ◎ | more than 2500 hours |
| O | 1500 to 2500 hours |
| Δ | 500 to 1500 hours |
| X | less than 500 hours |

Our experience indicates that this test accelerates passivation about 15 to 20 times higher than normal operation in a commercial chlorine cell.

TABLE 2

| Sample No. | Composition (mol %) Ru | Pt | Ir | Sn | Sb** | Cl generation efficiency | Lifetime |
|---|---|---|---|---|---|---|---|
| 1 | 20 | 10 | — | 70 | — | 85 | ◎ |
| 2 | 20 | 10 | — | 70 | (2) | 86 | ◎ |
| 3 | 20 | 7 | 3 | 70 | — | 88 | ◎ |
| 4 | 20 | 7 | 3 | 70 | (2) | 88 | ◎ |
| 5 | 20 | — | 10 | 70 | — | 82 | ◎ |
| 6 | 20 | — | 10 | 70 | (2) | 84 | ◎ |
| 7* | 20 | — | — | 80 | — | 74 | Δ |
| 8* | 30 | — | — | 70 | — | 77 | O |
| 9* | — | — | 20 | 80 | — | 70 | ◎ |
| 10* | 20 | — | 3 | 77 | — | 83 | ◎ |
| 11 | 20 | 3 | — | 77 | — | 82 | ◎ |
| 12* | — | 20 | — | 80 | — | 65 | X |
| 13* | — | 14 | 6 | 80 | — | 75 | O |

*Comparative Examples
**Antimony Sb content is expressed in mol % based on the tin.

The data in Table 2 shows that the electrodes of the present invention are highly efficient in evolving chlorine during an extended lifetime.

What is claimed is:

1. An electrode for use in electrolysis comprising an electroconductive substrate provided over at least a portion of its outer surface with a coating of a platinum group metal oxide catalyst, characterized in that said coating consisting essentially of
   (i) 3 to 45 mol% of ruthenium oxide,
   (ii) 0.1 to 30 mol % of at least one member selected from metallic platinum, platinum oxide, metallic platinum plus iridium oxide, and platinum oxide plus iridium oxide, and
   (iii) 50 to 96.9 mol % of tin oxide.

2. The electrode according to claim 1 wherein said substrate is selected from valve metals and alloys thereof.

3. The electrode according to claim 1 wherein said coating comprises
   (i) 10 to 30 mol% of ruthenium oxide,
   (ii) 5 to 15 mol% of at least one member selected from metallic platinum and platinum oxide plus iridium oxide, and
   (iii) 55 to 85 mol% of tin oxide.

4. The electrode according to claim 1 wherein component (ii) is at least one member selected form metallic platinum plus iridium oxide.

5. An electrode for use in electrolysis comprising an electroconductive substrate provided over at least a portion of its outer surface with a coating of a platinum group metal oxide catalyst, characterized in that said coating consists essentially of
   (i) 3 to 45 mol % of ruthenium oxide,
   (ii) 0.1 to 30 mol % of at least one member selected from metallic platinum, platinum oxide, and metallic platinum plus iridium oxide, and platinum oxide plus iridium oxide,
   (iii) 50 to 96.9 mol % of tin oxide with antimony substituting for not more than 10 mol % of the tin.

6. The electrode according to claim 5 wherein said substrate is selected from valve metals and alloys thereof.

7. The electrode according to claim 5 wherein said coating comprises
   (i) 10 to 30 mol% of ruthenium oxide,
   (ii) 5 to 15 mol% of at least one member selected from metallic platinum and platinum oxide plus iridium oxide, and
   (iii) 55 to 85 mol% of tin oxide.

8. The electrode according to claim 5 wherein component (ii) is at least one member selected form metallic platinum plus iridium oxide.

9. The electrode according to claim 5 wherein the antimony substitutes for not more than 5 mol% of the tin.

* * * * *